United States Patent [19]

Christianson

[11] 4,386,624

[45] Jun. 7, 1983

[54] PILOT CONTROLLED REGULATOR SECOND STAGE

[76] Inventor: Tony Christianson, P.O. Box 3700, Manhattan Beach, Calif. 90266

[21] Appl. No.: 295,535

[22] Filed: Aug. 24, 1981

Related U.S. Application Data

[62] Division of Ser. No. 84,421, Oct. 12, 1979, Pat. No. 4,297,998.

[51] Int. Cl.[3] ..... A62B 7/04

[52] U.S. Cl. ..... 137/102; 92/50; 128/204.26; 137/494; 137/DIG. 9

[58] Field of Search ..... 92/50; 128/204.26; 137/102, 116.5, 494, DIG. 8, DIG. 9; 251/61.3

[56] References Cited

U.S. PATENT DOCUMENTS

| | | | |
|---|---|---|---|
| 466,275 | 12/1891 | Fasoldt | 92/50 X |
| 3,028,859 | 4/1962 | Mitchell | 128/204.26 |
| 4,076,041 | 2/1978 | Christianson | 137/490 |
| 4,172,467 | 10/1979 | Warnow . | |

*Primary Examiner*—Robert G. Nilson
*Attorney, Agent, or Firm*—Spensley, Horn, Jubas & Lubitz

[57] ABSTRACT

This scuba regulator second stage includes the following improvements:

(a) a diaphragm assembly using a pair of generally conical flexible diaphragms facing each other and clamped together about a portion of their periphery, the unclamped peripheral sections flexibly spreading apart to function as an exhaust valve;

(b) a "detune button" which prevents inadvertent turn-on of the breathable gas supply valve during unattended use of the regulator, and which is automatically disengaged when the user begins to breathe through the regulator;

(c) a case configuration in which the breathable gas inlet tube is situated very close to the regulator mouthpiece so as to minimize the torque loading on the teeth of the user as the user's head is turned;

(d) a unitary valve configuration in which the entire breathable gas flow valve assembly is removable from the regulator case as an integral unit, without the use of tools;

(e) a valve poppet configuration which prevents tilting of the poppet when the breathable gas flow control valve is opened;

(f) resilient flap and seal members for preventing the entry of contaminants into the valve and diaphragm linkage housings; and (g) in a pneumatic amplification flow control valve, an improved pilot control pin and bleed orifice assembly having a balanced pressure control chamber.

3 Claims, 13 Drawing Figures

Fig. 6
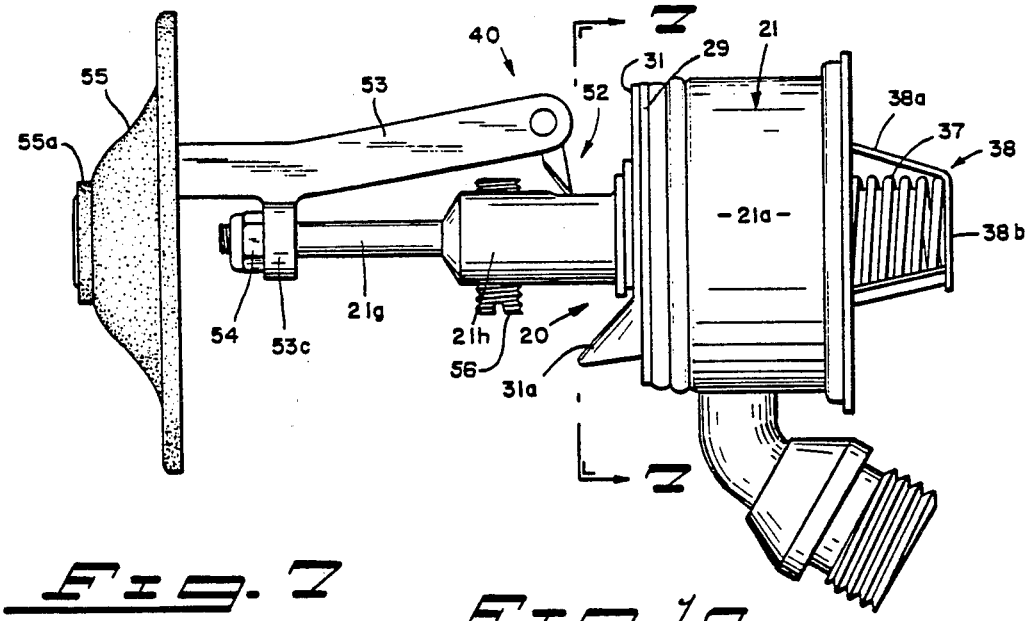
Fig. 7
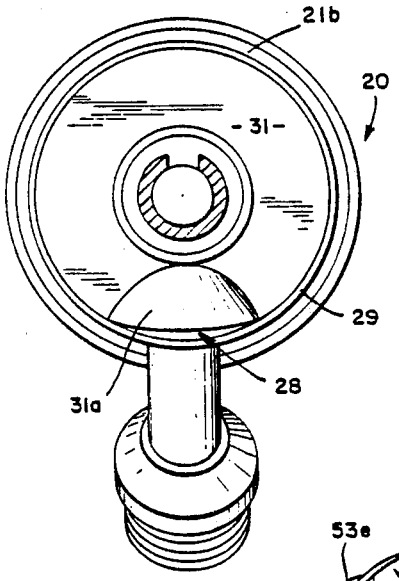
Fig. 1a
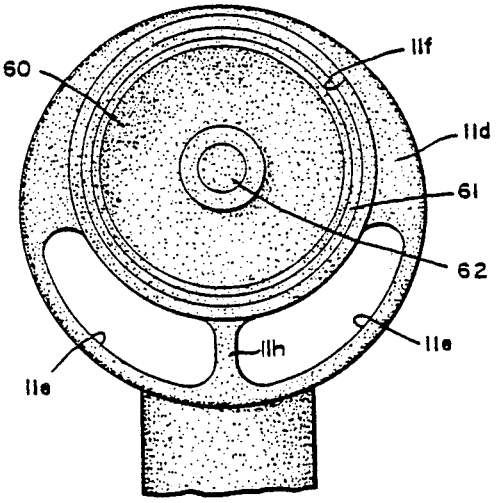
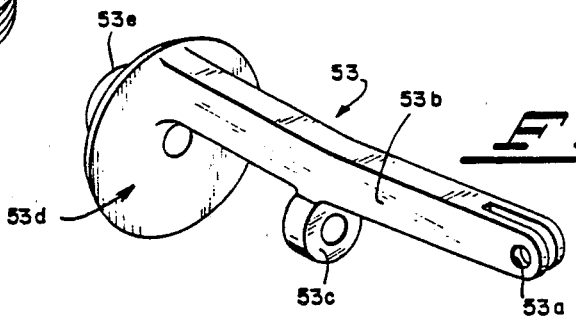
Fig. 8

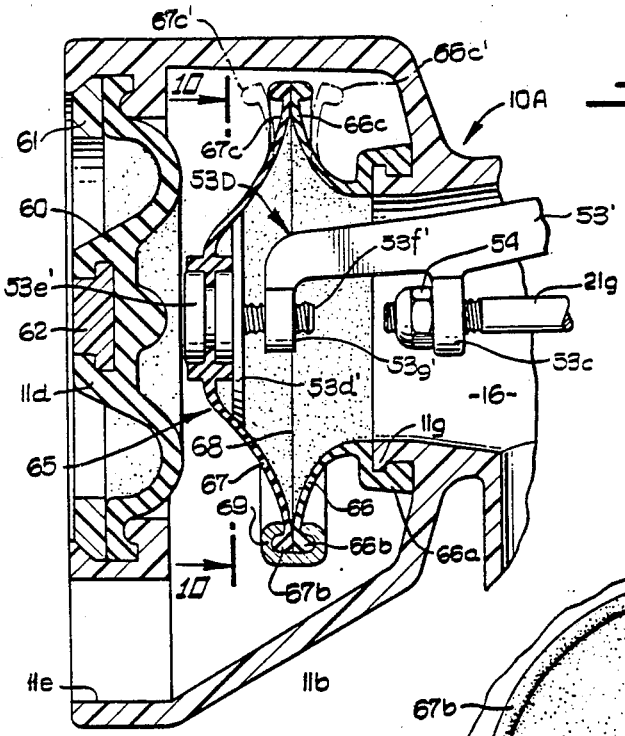
Fig. 9.
Fig. 10.
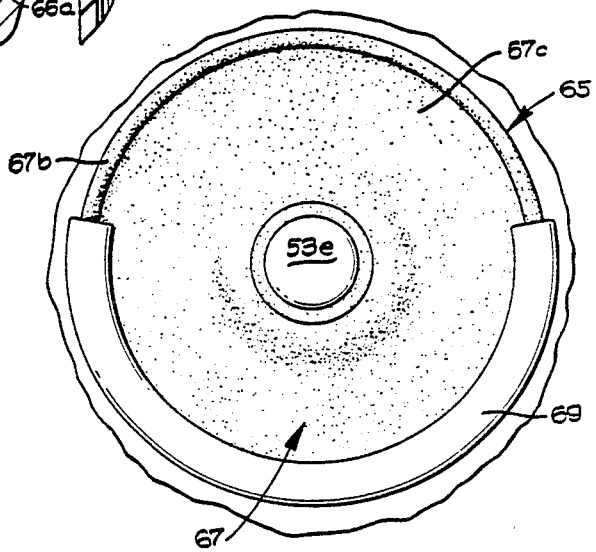
Fig. 11.
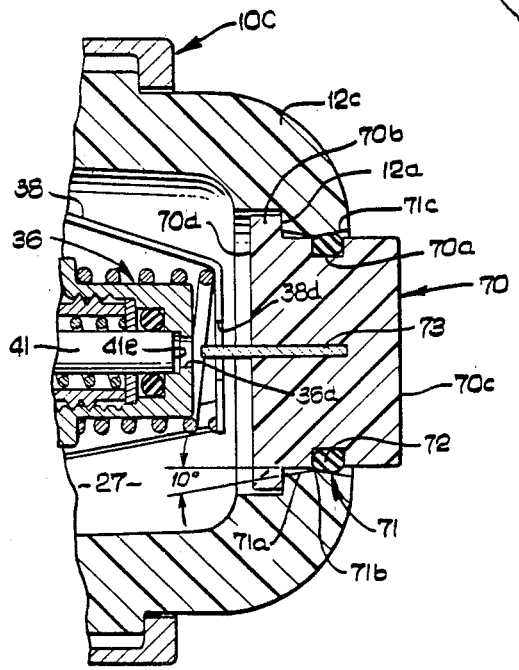
Fig. 12.
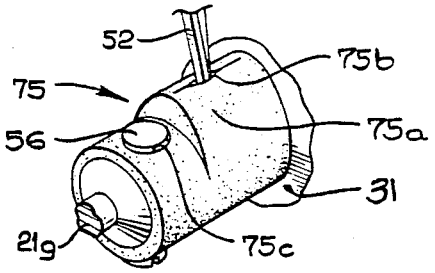

PILOT CONTROLLED REGULATOR SECOND STAGE

This is a division of application Ser. No. 84,421, filed October 12, 1979 now U.S. Pat. No. 4,297,998.

BACKGROUND OF THE INVENTION

1. Field of the Invention

The present invention relates to regulators for underwater breathing apparatus and more particularly to a scuba regulator second stage using pilot valve controlled pneumatic amplification.

2. Description of the Prior Art

In a typical self-contained underwater breathing apparatus (scuba), air or other breathable gas is supplied to a diver from a high pressure tank via a two-stage regulator. The regulator first stage is mounted at the supply tank and functions to reduce the air pressure to about 140 psi above the ambient pressure. Generally the tank and regulator first stage are supported on the diver's back. A conduit or hose supplies the reduced pressure air to a regulator second stage at the diver's mouthpiece. The second stage includes a demand valve system which opens to supply breathable gas in response to the inhalation effort of the diver. Provision is made to exhaust exhaled gas through the mouthpiece.

The use of pneumatic amplification in a scuba regular second stage is desirable to achieve very low inhalation effort. One such regulator is disclosed in the inventor's U.S. Pat. No. 4,076,041, issued Feb. 28, 1978 entitled PILOT VALVE OPERATED DEMAND REGULATOR FOR A BREATHING APPARATUS. Advantageously, but not necessarily, that regulator may be used in conjunction with a diaphragm having a variable effective sensing area, of the type shown in the inventor's U.S. Pat. No. 4,147,176, issued Apr. 3, 1979 entitled DIAPHRAGM ASSEMBLY FOR THE DEMAND REGULATOR OF A BREATHING APPARATUS. The diaphragm and regulator advantageously are linked by a mechanism of the type shown in the inventor's U.S. Pat. No. 4,029,120, issued June 14, 1977 entitled LINKAGE FOR THE DEMAND REGULATOR OF A BREATHING APPARATUS.

A regulator of the type utilizing these teachings has been found to achieve very low inhalation effort. That is, the diver can essentially inhale normally under water, and the regulator will respond to establish the proper flow of breathable gas. Unlike regulators which do not use pneumatic amplification, it is not necessary for the diver to use excessive inhalation force (i.e., to take a "deeper" breath than normal) to ensure opening of the valve.

However, the mechanism in the inventor's above mentioned patents were found to have certain features which merited improvement, and an object of the present invention is to facilitate such improvements.

For example, the pneumatic amplification valve shown in U.S. Pat. No. 4,076,041 could not be removed from its case intact, whereas it is an object of the present invention to provide a regulator in which the entire pilot and poppet valve mechanism can be removed from the case as a unitary assembly.

The poppet valve depicted in the U.S. Pat. No. 4,076,041 had some tendency to tilt when open. This was a possible source of instability. A further object of the present invention is to provide an assembly in which the poppet cannot tilt when either open or closed. Further, in the design shown in the U.S. Pat. No. 4,076,041 an unbalanced pressure condition could exist in the pilot control chamber, resulting in possible improper opening of the pilot valve. Yet another object of the present invention is to provide a regulator having a control chamber with balanced pressure so as to overcome this problem. These two improvements eliminate potential instability sources in the regulator.

Another objective of the present invention is to provide a simplified adjustment feature for the regulator linkage. In addition, another objective is to provide a simplified diaphragm mounting and linkage assembly.

Still another objective of the present invention is to provide a scuba regulator second stage in which the air supply hose inlet is situated immediately adjacent to the mouthpiece. This arrangement minimizes the torque force exerted on the regulator by the supply hose as the diver moves his head. Accordingly, using the present regulator, the diver is afforded more freedom of head motion without the risk of the regulator being pulled from his mouth by the torque force of the hose as the diver turns his head.

SUMMARY OF THE INVENTION

These and other objects are achieved by providing an improved scuba regulator second stage in which the hose inlet connection is physically situated immediately adjacent the regulator outlet and mouthpiece. The pilot and poppet valve assemblies are contained in a unitary housing which is readily removable from the case with all the components in working arrangement.

To eliminate tilting of the poppet assembly, the poppet itself is configured to have a central peripheral ridge which rides within the cylindrical poppet chamber. The particular configuration eliminates tilting. The poppet pin and bleed orifice are configured to have an effective outlet area from the control chamber which corresponds generally to the area of the pilot valve seat. Balanced pressure in the control chamber is achieved.

Also disclosed are an improved diaphram assembly having lower exhalation resistance and reduced water leakage, and a unique detune button for preventing inadvertent turn-on of the regulator during unattended use.

BRIEF DESCRIPTION OF THE DRAWINGS

A detailed description of the invention will be made with reference to the accompanying drawings wherein like numerals designate corresponding parts in the several figures.

FIG. 1 is a side elevation view and FIG. 1*a* is a front view of the improved scuba pilot regulator.

FIG. 6 is a side elevation view of the diaphragm and valve assembly removed from the regulator of FIG. 1.

FIG. 7 is a transverse sectional view of the valve assembly as seen along the line 7—7 of FIG. 6.

FIG. 8 is a pictorial view of the linkage also shown in FIGS. 2 and 7.

FIG. 9 is a partial transverse sectional view of another embodiment of the regulator of FIG. 1 having an improved diaphragm assembly.

FIG. 10 is an end view of the diaphragm assembly of FIG. 9 as viewed along the line 10—10 thereof.

FIG. 11 is a partial transverse sectional view of another embodiment of the regulator of FIG. 1 incorporating a detune button.

FIG. 12 is a perspective view of a sleeve seal for a portion of the linkage of the regulator of FIG. 1.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 1:
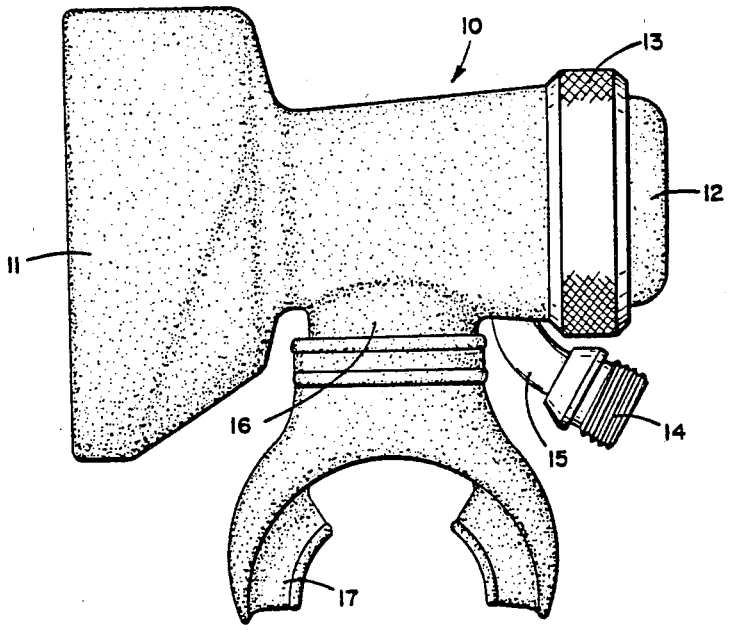

The inventive scuba pilot regulator 10 has the external configuration shown in FIG. 1 and includes a case 11 which advantageously is molded of a plastic such as Delrin having high impact resistance. As described below (FIG. 6), the regulator valve assembly unit 40 can be removed and inserted through the end of the case 11 which is covered by a cap 12 and a cap retainer ring 13. Air or other breathable gas mixture from a conventional tank and regulator first stage is supplied to the regulator 10 via an inlet fitting 14 and an inlet tube 15. The inlet tube 15 enters the case 11 in very close proximity to the regulator outlet 16 to which a rubber or plastic mouthpiece 17 is attached. This arrangement, in which the inlet tube 15 is situated very close to the mouthpiece 17 reduces the torque load on the user's teeth as the user's head is turned.

Figure 2:
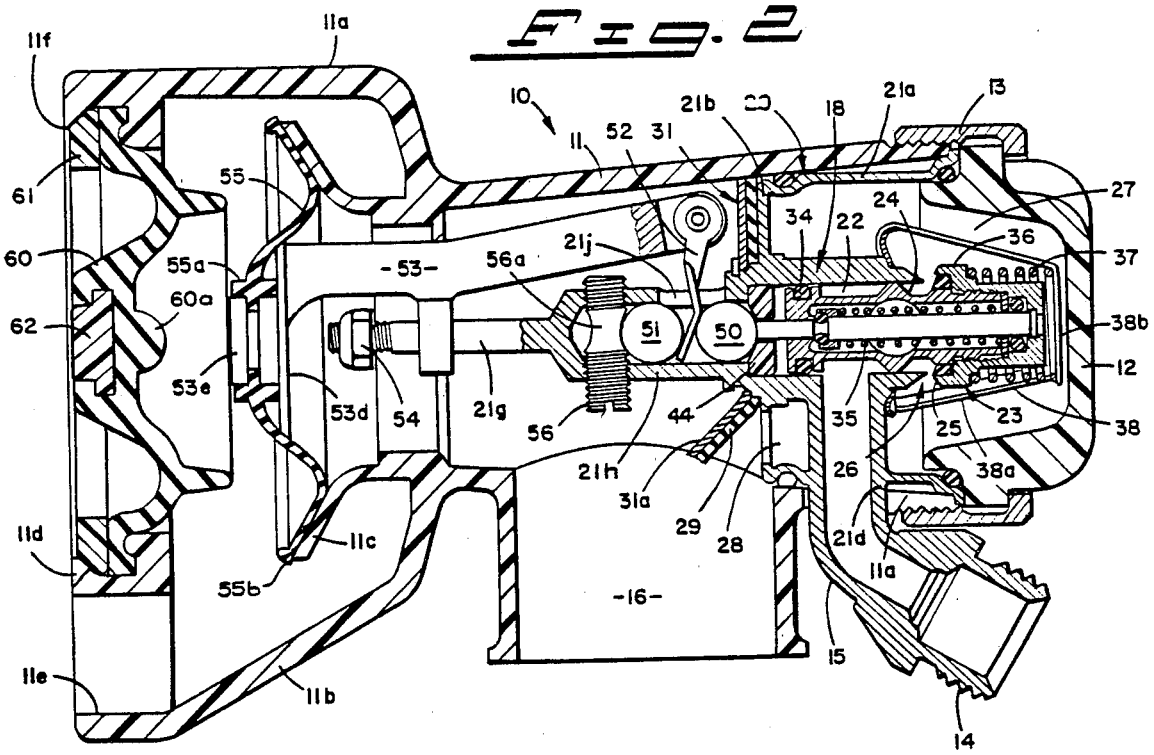
FIG. 2 is a longitudinal sectional view of the pilot regulator of FIG. 1, in the inhalation mode.
Figure 3:
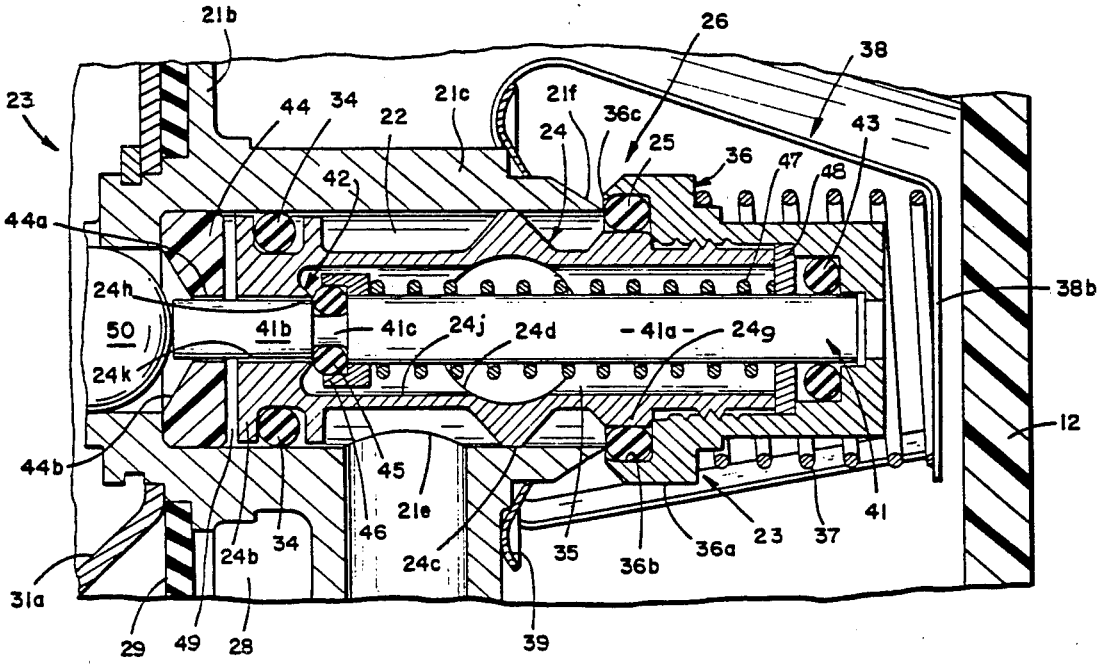
FIG. 3 is a partial longitudinal sectional view like that of FIG. 2, showing the pilot and poppet valves in the closed or neutral mode.

As shown in FIGS. 2 and 3, air flow to the user is controlled by a pilot valve mechanism 18, the general operating characteristics of which are described in the inventor's U.S. Pat. No. 4,076,041. The valve mechanism 18 is contained in a housing assembly 20 shown in FIGS. 2, 3, 6 and 7.

The assembly 20 includes a generally cup-shaped housing 21 having a cylindrical skirt **21*a*, a closed end 21*b* and an internal cylindrical section 21*c*. The inlet tube 15 extends through a sealed opening 21*d* in the skirt 21*a* and terminates at an opening 21*e* in the cylindrical section 21*c*. In this manner, inlet air is communicated into a chamber 22 with the cylindrical section 21*c*. As described below, the end 21*f* of the cylindrical section 21*c*** is tapered to form an annular edge which functions as the seat of the poppet valve which controls air flow to to the user.

A poppet assembly 23 (FIGS. 2 and 3) includes a poppet 24 (FIGS. 4 and 5) which is partially situated within the housing cylindrical section **21*c*. The assembly 23 includes an O-ring 25 which cooperates with the valve seat 21*f* to control the main air flow from the inlet tube 15 to the user. The valve seat 21*f* and the O-ring 25 thus comprise the principal flow-controlling components of a poppet valve 26**.

In the neutral mode of FIG. 3, the poppet valve 26 is closed, with the O-ring 25 in annular contact with the valve seat **21*f*. In this condition, air flow from the inlet tube 15 to the user is blocked. In the inhalation mode shown in FIG. 2, the poppet assembly 23 has moved toward the cap 12 so as to separate the O-ring 25 from the valve seat 21*f*. The valve 26 thus is open, thereby providing an air flow path from the chamber 22 past the open valve 26 into a larger annular chamber 27, the outer wall of which is defined by the skirt 21*a* of the housing 21. The chamber 27 is enclosed by the cap 12 (FIG. 2), so that the only outlet from the chamber 27 is an opening 28 (FIGS. 2 and 7) in the closed end 21*b* of the housing 21**.

As shown in FIG. 2, the entire housing closed end **21*b* including the opening 28 is covered by a flexible, disc-shaped seal 29 which advantageously is formed of 30-shore silicone or like material. The seal 29 is held in place by a rigid disc 31. The section 31*a* of the disc 31 which faces the opening 28 is bent away from the housing 21 as shown in FIGS. 2, 6 and 7. As inlet air flows from the open valve 26 through the chamber 27 and the opening 28, it pushes a flap of the seal 29 away from the housing end 21*b* and into contact with the disc deflector section 31*a* as shown in FIG. 2. The air flowing from the opening 28 thus is deflected by the seal 29 and the disc 31*a* toward the outlet 16 and mouthpiece 17. An aspiration or Venturi effect is achieved, the amount of which can be controlled by adjusting the angle of the disc deflection section 31*a*. In the neutral mode (FIG. 2) in which no air is flowing through the opening 28, the seal 29 covers the opening 28. This prevents the back flow of water into the chamber 27 and poppet assembly 23. Moreover, when the regulator 10 is not in use, the seal 29 prevents sand or other objectionable matter from getting into the poppet assembly 23**.

Figure 4:
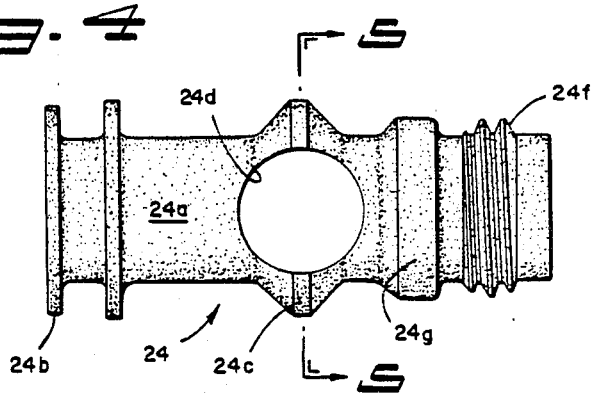
FIG. 4 is a side elevation view of the poppet also shown in FIGS. 2 and 3.
Figure 5:
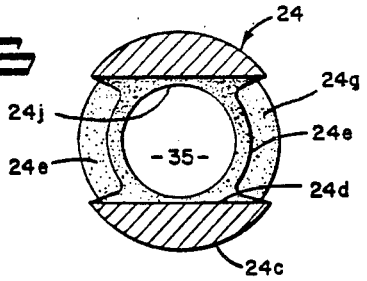
FIG. 5 is a transverse sectional view of the poppet, as seen along the line 5—5 of FIG. 4.

The poppet assembly 23 includes an improved poppet 24 having the configuration shown in FIGS. 4 and 5. It has a cylindrical section **24*a* having an outside diameter at a somewhat smaller than the inside diameter of the housing cylindrical section 21*c*. The section 24*a* thus defines the inner wall of the chamber 22. One end 24*b* of the poppet 24 has an outer diameter corresponding to the inner diameter of the housing cylindrical section 21*c*, and is grooved to retain an O-ring 34. The poppet end 24*b* thus defines one end of the chamber 22**.

The poppet 24 has an annular flange or ridge **24*c* the outer diameter of which also corresponds to the inside diameter of the cylindrical section 21*c*. The poppet 24 is axially movable within the cylindrical section 21*c* between the closed position of FIG. 3 and the open position of FIG. 2. During such movement, the flange 24*c* remains substantially in contact with the cylindrical 21*c*. This ensures that the poppet 24 remains coaxially aligned within the cylindrical section 21*c* regardless of the axial position of the poppet 24. In other words, the flange 24*c* prevents tilting of the poppet 24**.

A relatively large hole **24*d* extends transversely all the way through the poppet 24. The axis of the hole 24*d* advantageously is aligned with the median plane of the flange 24*c*. The hole 24*d* accomplishes two functions. First, it provides an air flow path from the chamber 22 into a cylindrical pilot valve chamber 35 within the poppet 24. Secondly, it established a flow path within the chamber 22 past the flange 24*c* itself. As best seen in FIG. 5, as a result of the hole 24*d*, the flange 24*c* itself does not form a complete circle. Rather, it has two "missing" sections 24*e*, through which air can flow past the flange 24*c*. Thus, when the valve 26 is open (FIG. 2) the inlet air flows from the tube 15 into the chamber 22 and past the flange 24*c* via the "missing" sections 24*e* to the valve 26**.

At the valve 26 the O-ring 25 is held in place by a poppet cap 36 which is screw threaded to the end **24*f* of the poppet 24. The cap 36 includes an enlarged annular flange 36*a*** the front face of which has a recess or groove 36*b* that receives the O-ring 25. This groove 36*b* is slightly undercut so as to form within the groove 36*b* an annular "hook" 36*c* which (when viewed in cross-section as in FIG. 2 or 3) overhangs a portion of the O-ring 25 that is facing the valve seat 21*f*. With this arrangement, the O-ring 25 is positively retained or locked in place between the cap 36 and the poppet section 24*g*. These two members surround approximately ¾ of the periphery of the O-ring 25, leaving exposed only that portion of the periphery adjacent to the annular line of contact with the valve seat 21*f*. There is no tendency for the O-ring 25 to become displaced during regulator operation.

The poppet assembly 23 is biased toward the housing 21 by a poppet spring 37 one end of which surrounds the poppet cap 36 abuts against the flange 36*a*. The other end of the spring 37 seats against a retainer 38 that has a generally U-shaped cross-section including legs 38*a* the ends of which are attached by means of a retaining ring 39 to the housing cylindrical section 21*c*. The spring retaining end 38*b* of the retainer 38 advantageously is disc-shaped. Typically, there may be three legs 38*a*. With this spring retention arrangement, the entire valve housing assembly 20 and poppet assembly 23 can be removed from the case 11 as a unit 40 (FIG. 6) after the cap 12 and cap ring 13 have been taken off. Such removal is further facilitated by a slot 11*a* in the case 11. The inlet tube 15 is situated within this slot 11*a* and slides through the slot as the housing assembly 20 is removed. Note that removal of the assembly 23 can be accomplished by hand, without the use of tools.

Another improvement of the present invention concerns the configuration of the pilot pin 41 and other components of the pilot valve 42. The valve itself consists of an annular valve seat 24*h* formed in the poppet 24 at the forward end of the chamber 35. The poppet 24 includes an interior coaxial bore 24*j* extending from the end of the poppet that is covered by the cap 36 almost all of the way to the poppet end 24*b*. A second coaxial bore 24*k* of diameter less than that of the bore 24*j*, extends through the end 24*b* into the chamber 35 that is defined by the bore 24*k*. The interior end of the bore 24*k* is not flat, but rather is "hook" shaped when viewed in cross-section (FIGS. 2 and 3) so as to define the annular edge-shaped valve seat 24*b*.

The pilot pin 41 includes a rear section 41*a* which extends through the chamber 35 and extends into a central opening in the poppet cap 36. At this rear end, the pin 41 is sealed by an O-ring 43 that is caught within the poppet cap 36. The other end 41*b* of the pin 41 projects through the bore 24*k* and through an orifice member 44 into contact with one of the balls 50 in the diaphragm linkage assembly described below. Between the sections 41*a* and 41*b* in the pin 41, there is an annular groove 41*c* which receives an O-ring 45 that serves as the closure member of the pilot valve 42. The O-ring 45 is held in place by a ring 46 that surrounds a portion of the pin 41. The ring 46 includes an annular lip that covers the portion of the O-ring 45 periphery that is radially outward of the groove 41*c*. In this manner, the O-ring 45 is firmly retained by the pin 41 and the ring 46 with only a relatively small portion of its periphery exposed for contact with the pilot valve seat 24*h*.

The poppet bore 24*k* has a diameter which is essentially the same as the diameter of the pilot valve seat 24*h*. The pin 41*b* has a diameter slightly less than that of the bore 24*k* so that when the pilot valve 42 is opened, inlet air will flow from the chamber 22 via the poppet bore 24*d* and the chamber 35 through the space between the O-ring 46 and the valve seat 24*h* into the space between the bore 24*k* and the pin end 41*b*, and thence into a control chamber 49 between the poppet 24 and the orifice member 44. The resultant build-up of pressure in the chamber 49 urges the entire poppet 24 to the right as viewed in FIGS. 2 and 3, tbhereby opening the pilot valve 26. The air in the chamber 49 leaks out via the space between the central bore or orifice 44*a* in the member 44 and the pin end 41*b*. In effect, the pressure drop across the orifice 44*a* provides the controlling pressure which opens the main poppet vale 26.

In accordance with the present invention, the diameter of the orifice 44*a* is roughly the same as the diameter of the bore 24*k*, so that the area of the annular opening between the orifice 44*a* and the pin end 41*b* is roughly the same as the seating area of the pilot valve 42. As a result, when pressurized inlet air is present in the chamber 49, there is an equal pressure exerted to the right (as viewed in FIGS. 2 and 3) toward the valve closure 46 and to the left toward the orifice 44*a*. As a result, the pressure within the control chamber 49 is balanced.

This is in contrast to the design shown in the inventor's U.S. Pat. No. 4,076,041 in which the bleed orifice was of smaller diameter than the pilot valve seat. Because of this difference, the annular orifice area surrounding the pin was significantly less than the valve seat area. A pressure imbalance resulted in the control chamber, which tended to keep the pilot valve open when it should have become closed as air leaked out of the control chamber through the orifice. This imbalance is eliminated in the present invention, thereby eliminating a potential source of instability in the regulator 10.

Referring to FIGS. 2 and 6, the housing assembly 20 further includes a guide rod 21*g* extending coaxially from a cylindrical section 21*h* that projects forwardly from the cup shaped housing 21. The cylindrical section 21*h* contains a pair of rigid balls 50, 51 which together with a lever 52 and a linkage arm 53 constitute the linkage between the pilot valve 42 and a diaphragm 55. The basic operation of this linkage is disclosed in the inventor's U.S. Pat. No. 4,029,120.

The configuration of the linkage arm 53, which typically is made of Delrin or other rigid plastic material, best is shown in FIG. 8. The lever 52 is pivotally connected to one end 53*a* of the arm 53 and extends through an opening 21*j* in the cylindrical section 21*h* into the space between the balls 50 and 51. A ring 53*c* integrally formed near the middle of the arm 53*b* loosely surrounds and is guided by the rod 21*g*. A lock nut 54 is threaded on the end of the rod 21*g* to serve as a stop for the arm 53. A disc-shaped end 53*d* of the arm 53 serves as a central rest for the diaphragm 55, the center 55*a* of which has an internally flanged opening that is configured for mounting on a peripherally grooved boss 53*e* extending from the arm 53 in coaxial alignment with the guide ring 53*c*. The diaphragm 55 is situated within an enlarged end 11*a*, 11*b* of the case 11 and seats against an internal conical platform 11*c* which is formed as an integral part of the case 11. The diaphragm 55 and the conical platform 11*c* cooperate as a diaphragm assembly of the type taught by the inventor's U.S. Pat. No. 4,147,176. The effective sensing area of the diaphragm is reduced in uniform proportion to the diaphragm displacement.

When in use, during inhalation the pressure at the regulator outlet 16 is reduced, causing the diaphragm 55 to be displaced toward the right as viewed in FIG. 2.

This displacement causes a concomitant movement toward the right of the linkage arm 53, thereby causing the lever 52 to move the ball 50 and hence the pin 41 to the right. This opens the pilot valve 42, permitting a flow of inlet air to the control chamber 49. The pressure of this air in turn opens the poppet valve 26, supplying air to the user via the orifice 28 and the outlet 16. The deflector section 31*a* deflects the air from the opening 28 toward the outlet 16, and prevents a direct flow of air toward the diaphragm 55. Stability is improved, while at the same time a Venturi effect is achieved.

Adjustment of the linkage assembly is facilitated by a screw 56 which extends through the cylindrical section 21*h* and which has a central concave area 56*a* that serves as a rigid stop for the ball 51. By moving the screw 56 in or out, the rest position of the ball 51 is changed. By means of this adjustment, the rest position of the ball 51 can be established so that the ball 50 will immediately start to move when the diaphragm 55 first is displaced. In the embodiment shown in FIG. 2, the adjustment end of the screw 56 faces the regulator outlet 16. This permits easy adjustment by the entry of a screwdriver through the outlet 16. However, to discourage "tinkering" by the user, the adjustment screw 56 could be mounted so as to face an interior side wall of the housing 11. In that instance, it could be adjusted when the entire assembly 40 is removed from the casing 11 (as shown in FIG. 6).

The diaphragm 55 also functions as the exhaust valve for the regulator 10. To this end, the outer perimeter 55*b* of the diaphragm 55 is free to move away from the platform 11*c*. Thus during breathing, the exhaled air flows into the regulator outlet 16, pushes the diaphragm edge 55*b* away from the platform 11*c*, and escapes through the openings 11*e* (FIGS. 1*a* and 2) at the front end of the case 11.

Also situated at the front end 11*d* is a cover 60 which is held within a large opening 11*f* by means of a ring 61. The cover 60 is made of a flexible material such as Neoprene and supports a central purge button 62. When this button is pressed, a central portion 60*a* of the flexible cover 60 pushes against the boss 53*e* so as to displace the linkage arm 53 and open the regulator valve. Purging occurs.

In the alternative embodiment of FIGS. 9 and 10, the regulator 10A features an improved diaphragm assembly 65 which has very low exhaust pressure, and which aids in preventing leakage of water into the regulator interior and thence into the diver's mouth.

These features are achieved by replacing the rigid conical platform 11*c* (of the embodiment of FIG. 2) with a flexible inner diaphragm 66 (FIG. 9) that preferably is made of a soft pliable rubber such as 30-shore silicone. The diaphragm 66 has a large central opening surrounded by an annular retainer section 66*a* of generally U-shaped cross-section that matingly engages a flange-shaped interior section 11*g* of the regulator plastic housing 11.

The outer diaphragm 67 likewise advantageously is formed of 30-shore silicone rubber or a like soft, pliable material which returns rapidly to its original shape after being deformed. The general configuration of the outer diaphragm 67 corresponds to that of the diaphragm 55 in FIG. 2, and it is similarly mounted to the linkage arm 53'.

The inner and outer diaphragms 66 and 67 are of equal diameter, and contact one another around their periphery in a median plane 68. The outer periphery of each diaphragm 66, 67 has a respective integral bead 66*b*, 67*b*. The two diaphragms are clamped together over approximately one-half of their circumference by a rigid plastic clamp 69 having a generally U-shaped cross-section, as shown in FIG. 9. The center of the clamp is situated near the bottom of the regulator 10A in proximity to the housing section 11*h* (FIG. 1*a*) between the openings 11*e*. The unclamped sections 66*c*, 67*c* of the diaphragms thus are situated near the top of the regulator 10A.

With this arrangement, during exhalation the exhaust gasses spread apart both the diaphragm sections 66*c* and 67*c*, as to the positions shown in phantom at 66*c'*, 67*c'* in FIG. 9. Since the exhaled air moves apart both soft rubber diaphragms 66, 67 less exhalation pressure may be required than with the embodiment of FIG. 2.

During inhalation, the decreased pressure at the mouthpiece outlet 16 causes both the inner and outer diaphragms 66 and 67 to compress toward one another, with concomitant movement to the right (as viewed in FIG. 9) of the median plane 68 and the linkage arm 53'. As the two diaphragms 66, 67 come into contact with one another, reduced effective sensing area is achieved. However, unlike the configuration of FIG. 2, the outer diaphragm 67 does not have to invert its shape during this operation. This appears to result in a reduction in the amount of inhalation pressure required to move the linkage arm 53' by the same distance, as compared with the embodiment of FIG. 2.

With the configuration of FIG. 9, undesirable leakage of water past the diaphragm assembly 65 into the interior of the regulator 10A is significantly reduced. This results both from the fact that the lower one-half of the diaphragm 67 circumference is clamped to the inner diaphragm 66, and also from the fact that a very good seal is provided by the mutual contact of the two rubber diaphragms in the unclamped regions 66*c*, 67*c*.

Yet another improvement is shown in the embodiment 10C of FIG. 11 which includes a "detune" button 70 which prevents inadvertent turn-on of the regulator during unattended use. There are two typical situations when such inadvertent turn-on may occur. First, the regulator may be used in an "octopus" arrangement in which two regulator second stages are attached by separate hoses to the same tank and regulator first stage. This arrangement now is commonly used by divers as a safety situation in which the diver normally breathes through one of the two second stages. The other is available for use in an emergency either by the diver himself (if his normal mouthpiece should fail) or by another diver. Another circumstance is when the diver is swimming on the surface with a snorkel, with his regulator out of his mouth. In either situation, the interior of the unused regulator becomes flooded with water. As the diver moves, the resultant fluctuations of the interior water pressure may cause displacement of the diaphragm 55 (FIG. 2) or diaphragm assembly 66 (FIG. 9). This will cause the regulator to open with undesirable flow-through of compressed air from the tank. The detune button 70 is intended to eliminate such regulator turn-on during unattended use.

To this end, the detune button 70 is mounted within a circular opening 71 in the cap 12C. The interior surface of the opening 71 is ridge-shaped, and includes an interior tapered or conical surface 71*a* which increases in diameter from the center 71*b* of the ridge 71 toward the interior of the regulator 10C, with a typical taper angle of 10°. A second tapered surface 71*c* extends from the ridge 71*b* toward the exterior of the regulator 10C with increasing radius.

An O-ring 72 seats within a peripheral recess 70*a* in the button 70 in contact with the opening 71. The interior face of the button 70 includes a peripheral flange 70*b* which seats against an inner shoulder 12*a* of the cap 12C when the detune button 70 is in the disengaged position shown in FIG. 11. The groove 70*a* is situated so that in this disengaged position the O-ring 72 is seated against the outer tapered surface 71*c*.

Projecting inwardly from the center of the detune button 70 is a pin 73. This pin 73 projects through an opening 38*d* in the end 38*b* of the spring retainer 38. Pin 73 faces the rear end 41*e* of the pilot pin 41 through an opening 36*d* at the rear of the poppet cap 36. The length of the pin 73 is selected so that when the detune button 70 is in the disengaged position shown in FIG. 11 there is sufficient clearance between it and the pin end 41*e* so as to allow movement of the pin 41 during operation of the regulator 10C.

To engage the detune button 70, the user pushes to the left against the outer surface 70*c* of the button 70 so as to urge the O-ring 72 past the ridge 71*b*. In this engaged position, the rod 73 abuts against the end 41*e* of the pin 41. The pressure of the O-ring 72 against the inner tapered surface 71*a* creates a component of force toward the left (as viewed in FIG. 11) which is communicated via the pin 73 to the pin 41. Now, when the regulator 10C is underwater but out of the diver's mouth, the pressure variations of the water against the interior of the diaphragm 55 or diaphragm assembly 65 will be insufficient to overcome the force exerted on the pin 41 by the detune button 70. Inadvertent opening of the regulator 10C, with undesired air flowthrough, will be prevented.

On the other hand, when the diver takes the regulator 10C into his mouth, the detune button 70 can be automatically snapped back into the disengaged position by taking an initial "deep breath". By sharply inhaling, sufficient differential pressure will be created across the diaphragm 55 or the diaphragm assembly 65 so as to slightly displace the pin 41 to the right as viewed in FIG. 11. This displacement need only be sufficient to crack open the pilot valve 42, and to slightly move the detune button 70 toward the right. The force does not have to be sufficient to move the O-ring 72 past the ridge 71*b*. As soon as the pilot valve 42 is slightly opened, a concomitant opening of the poppet valve 26 will occur. High pressure inlet air immediately will be provided into the interior chamber 27 and will press against the inner surface 70*d* of the detune button 70. This resultant increased pressure will then snap the detune button 70 into the disabled position, in this process forcing the O-ring 72 past the ridge 71*b*. Thereafter the regulator 10C will operate in a normal unimpeded manner.

Thus the detune button 70 can be simply engaged by finger pressure on the surface 70*c* prior to unattended use of the regulator. There is no need manually to disengage the detune button when the regulator later is to be used. The diver need only put the regulator 10C in his mouth and take an initial strong breath to snap the detune button 70 to the disengaged position.

Advantageously, the movement distance required to transfer the detune button from the engaged to the disengaged position is greater than that required to engage the purge button 62. Thus when the air source is turned off, depression of the purge button will not transfer the detune button from the engaged to the disengaged position. However, with the air source turned on, depression of the purge button will crack open the pilot valve 42, with concomitant slight opening of the poppet valve 26. This will allow sufficient inlet air to enter the chamber 27 so as to force the detune button into the disengaged position. Thus as an alternative to using an initial strong breath to snap the detune button into the disabled position, the user can merely depress the purge button 62.

Other additional features or variations may be incorporated in the inventive regulator second stage. For example, in the embodiment shown in FIGS. 2 and 8, the disc-shaped end 53*d* is a unitary part of the linkage arm 53. However, the invention is not so limited. As an alternative, the diaphragm-supporting disc-shaped end member 53D may be a separate member, as shown in FIG. 9. The member 53D has a threaded stem 53*f'* which extends from the disc 53*d'* in a direction opposite from the boss 53*e'*. This stem 53*f'* engages a threaded ring 53*g'* formed at the end of the arm 53' concentric with but spaced from the ring 53*c*. Such an arrangement permits adjustment of the rest position of the diaphragm 67.

In the embodiment of FIG. 11, the pin 73 is illustrated as being a thin metal rod extending from a hole in a plastic detune button 70. As an alternative, the detune button and pin may be formed as a unitary, all plastic member in which the pin comprises an integral boss or protuberance extending from the surface 70*d* of the button which faces the regulator interior chamber 27.

As noted above, when the regulator 10 is not in use, the seal 29 prevents contamination from getting into the poppet assembly 23. To prevent sand or other matter from entering into the cylindrical section 21*h* (FIGS. 2 and 6) through the opening 21*j*, a generally cylindrical sleeve 75 (FIG. 12) of silicone plastic or like resilient material may be placed around the exterior of the cylindrical section 21*h*. Such a sleeve 75 advantagously includes a bulge region 75*a* which covers the opening 21*j* and is provided with a slit 75*b* through which the lever 52 projects. The bulge 75*a* and slit 75*b* thus form a lip-like seal which will prevent contamination from entering into the region of the linkage balls 50, 51 while permitting necessary movement of the lever 52. A pair of holes 75*c* in the sleeve 75 fit over the adjustment screw 56 to retain the sleeve in place on the cylindrical section 21*h*.

I claim:

1. An improved diaphragm assembly for use in a breathing apparatus of the type having an air flow control valve situated within a case and operative to supply breathable gas to a user in response to sensed inhalation pressure, comprising:

a first resilient, generally conical diaphragm, having an open central portion the periphery of which central portion is attached to said case interiorly thereof, a second resilient, generally conical diaphragm facing said first diaphragm with the outer periphery of said first diaphragm being in contact with the outer periphery of said second diaphragm, each diaphragm generally decreasing in diameter with increasing distance from the other diaphragm, the space between said first and second diaphragms being exposed to the user's inhalation pressure communicated via said central opening, wherein the outer peripheries of said first and second diaphragms are connected together in a first region and are not connected together in a second region, the outer peripheries in said second region being displaceable away from each other by the pressure of exhaled gases communicated via said central opening to said space between said diaphragms, thereby permitting the exhaust of said exhaled gases through the resultant opening, and linkage means for transmitting displacement of said second diaphragm to said air flow control valve.

2. A diaphragm assembly according to claim 1 wherein the peripheries of said first and second diaphragms are connected by an arcuate clamp.

3. A diaphragm assembly according to claim 1 or 2 wherein said breathing apparatus is the second stage of a scuba regulator, wherein said case has an opening to permit the introduction of water into an interior chamber of said case to which the outside surfaces of said first and second diaphragms are exposed and to permit the expulsion of excluded gases from said same interior chamber, and wherein said second, unconnected region of the diaphragm peripheries is further from said case opening than said first, connected region of said diaphragm peripheries.

* * * * *